United States Patent [19]

Wight et al.

[11] Patent Number: 4,776,140

[45] Date of Patent: Oct. 11, 1988

[54] MODULAR BLOCK ANCHOR

[75] Inventors: James H. Wight, Poway; William J Rose, El Cajon; Ronald G. Unkefer, San Diego, all of Calif.

[73] Assignee: San Diego Gas and Electric, San Diego, Calif.

[21] Appl. No.: 893,682

[22] Filed: Aug. 6, 1986

[51] Int. Cl.[4] ..... E04G 21/14; E02D 5/54; E02D 23/02

[52] U.S. Cl. ..... 52/125.5; 52/125.4; 52/148; 52/166; 405/205; 405/224

[58] Field of Search ..... 52/125.5, 125.4, 148, 52/166; 114/121, 294; 16/216, 218, 217; 108/55.3, 53.1, 53.3, 55.1; 405/205, 224

[56] References Cited

U.S. PATENT DOCUMENTS

| | | | |
|---|---|---|---|
| 1,534,767 | 4/1925 | Brogden | 16/218 |
| 1,549,356 | 8/1925 | Goldbeck . | |
| 1,777,469 | 10/1930 | Luippold et al. | 52/166 |
| 2,032,030 | 2/1936 | Talen | 52/166 |
| 2,187,871 | 1/1940 | Voorhees | 405/205 X |
| 2,483,068 | 9/1949 | Smith | 16/217 X |
| 2,684,842 | 7/1954 | Crespi et al. | 52/125.4 |
| 2,887,195 | 5/1959 | Jackson . | |
| 3,033,529 | 5/1962 | Pierrat . | |
| 3,118,416 | 1/1964 | Sawyer | 405/205 X |
| 3,611,734 | 10/1971 | Motto | 114/294 X |
| 3,685,244 | 8/1972 | Palmer | 52/125.4 X |
| 3,994,108 | 11/1976 | Johnson . | |
| 4,038,793 | 8/1977 | Roca | 52/125.4 |
| 4,263,855 | 4/1981 | Lawlor | 108/55.3 X |
| 4,580,680 | 4/1986 | Wind | 108/55.3 X |

FOREIGN PATENT DOCUMENTS

| | | | |
|---|---|---|---|
| 1268059 | 5/1968 | Fed. Rep. of Germany | 108/55.3 |
| 7420 | of 1894 | United Kingdom | 16/216 |

*Primary Examiner*—Alfred C. Perham
*Attorney, Agent, or Firm*—Spensley Horn Jubas & Lubitz

[57] ABSTRACT

An anchor for supporting guy wires for transmission towers and other structures. The anchor includes a cradle or base skid which supports a plurality of modular deadweight bodies which may interlock to increase the overall stability of the anchor.

18 Claims, 2 Drawing Sheets

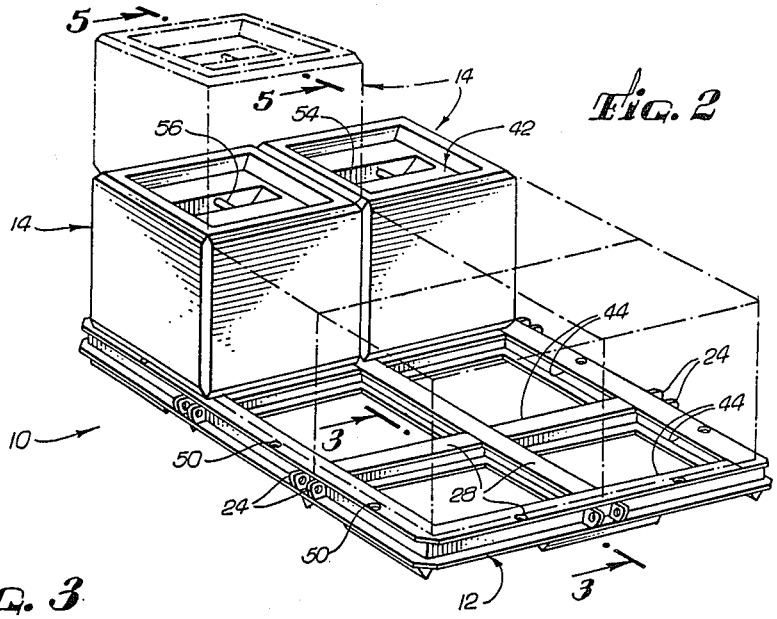
FIG. 2
FIG. 3
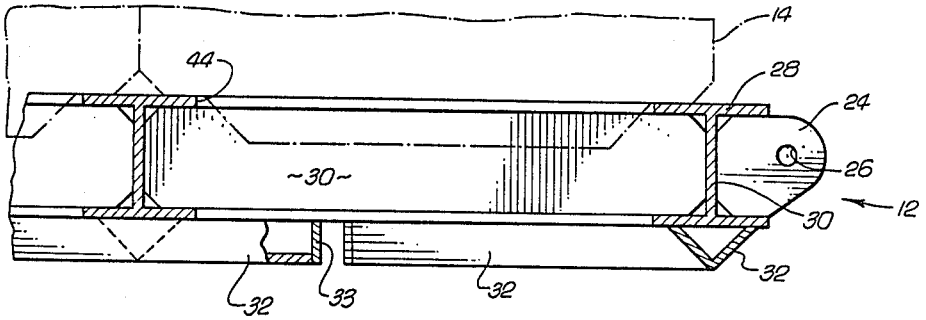
FIG. 4
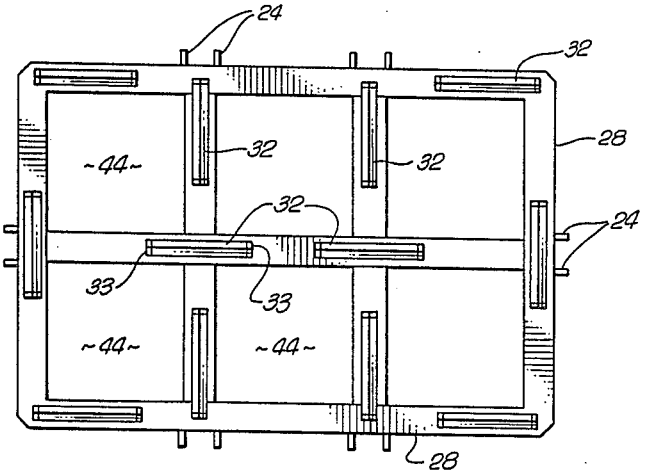

MODULAR BLOCK ANCHOR

BACKGROUND OF THE INVENTION

1. Field of the Invention

The present invention relates to anchors for temporary transmission line towers and other structures which utilize temporary anchors.

2. Background Discussion

If power line transmission towers are damaged by high winds or other causes, utility companies often install temporary towers in order to quickly restore power while the permanent transmission towers are repaired. These temporary transmission towers are typically held in place by a number of guy wires, each of which is fastened to the tower at one end and anchored to the ground at the other end.

To anchor these guy wires, one approach has been to attach the ends of each guy wire to a heavy construction vehicle such as a bulldozer which usually has sufficient weight to resist substantial movement of a temporary transmission towers. Alternatively, below ground anchors such as screw anchors, deadman anchors and sulfur anchors have also been used to provide secure attachment points for the guy wires.

However, power transmission lines often pass through remote or rugged areas in which it can be very difficult to bring heavy construction equipment to provide anchors for the temporary transmission towers. The transmission towers may also be located in environmentally sensitive areas in which the digging of below ground anchors is to be avoided.

SUMMARY OF THE INVENTION

It is an object of the present invention to provide an anchor obviating, for practical purposes, the above-mentioned limitations.

It is a further object of the present invention to provide an anchor which is easily transportable by truck or helicopter and requires minimal space.

It is another object of the present invention to provide an anchor which is suitable for a variety of structural loading uses and a variety of soil and terrain conditions.

It is still another object of the present invention to provide an anchor which causes a minimum of disturbance to environmentally sensitive areas and adjacent agricultural activities.

These and other advantages are achieved in an anchor which, in the illustrated embodiment, includes a base skid and a plurality of deadweight modular bodies adapted to rest on the base skid. In the illustrated embodiment, each body is shaped as a block designed to interlock with the skid or an adjacent block. Blocks may be added or removed from the base skid to provide sufficient resistance to uplifting or lateral forces to maintain the transmission tower or other temporary structure in a stable position.

BRIEF DESCRIPTION OF THE DRAWINGS

FIG. 2 is a pictorial view of a base skid and a plurality of modular blocks of one the anchors of FIG. 1;

FIG. 3 is a cross-sectional view of a portion of the base skid of FIG. 2 shown along the lines 3—3;

FIG. 4 is a bottom view of the base skid of FIG. 2;

DETAILED DESCRIPTION OF THE DRAWINGS

Figure 1:
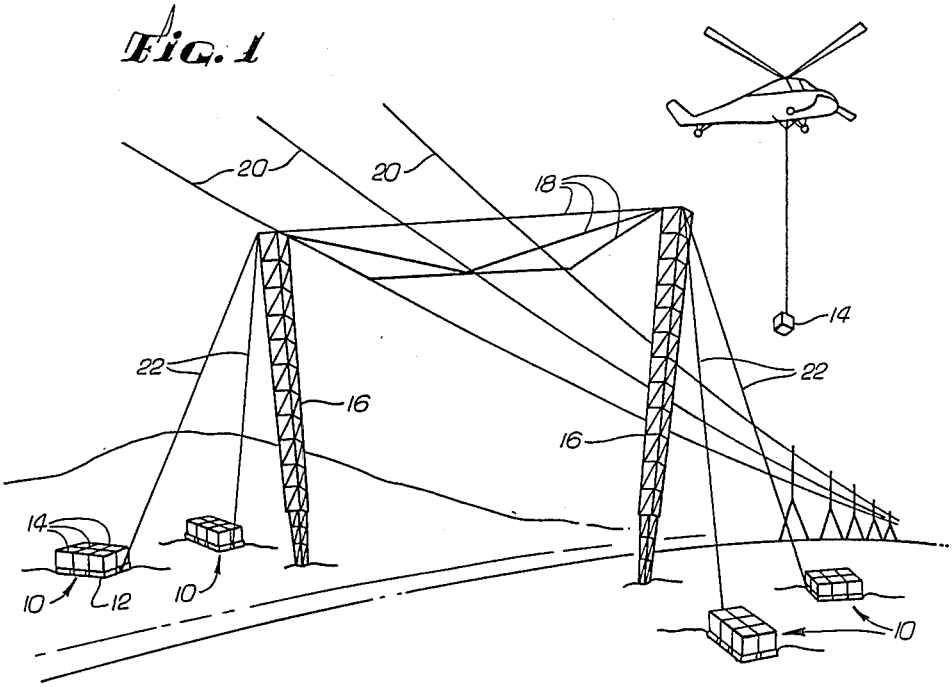
FIG. 1 is a pictorial view of a modular anchor system in accordance with a preferred embodiment of the present invention, shown deployed to anchor the guy wires of temporary power transmission tower structures.

A plurality of modular block anchors in accordance with a preferred embodiment of the present invention is indicated generally at 10 in FIGS. 1 and 2. Each anchor 10 includes a sled or base skid 12 which supports a plurality of deadweight bodies 14. In the illustrated embodiment, each deadweight body 14 is a generally cubical block of concrete. As will be discussed in greater detail below, each block 14 is modular in design and can interlock with the base skid 12 or an adjacent block 14 to provide lateral stability.

For purposes of illustration, the anchors 10 of the illustrated embodiment are shown anchoring a pair of temporary power transmission towers 16. Suspended from the towers 16 are lateral cables 18 which support the power transmission lines 20 while permanent transmission towers are repaired or replaced. Temporary transmission towers typically require anchored guy wires such as those indicated at 22 to secure the towers in an upright position. As previously mentioned, these guy wires have previously been secured to heavy construction vehicles such as bulldozers to anchor the guy wires in place. However, since power transmission lines often pass through mountainous or other inaccessible areas, it is not always practical to bring heavy construction vehicles to the site of the transmission tower needing repair. Even in relatively flat and close in areas, it may be difficult to transport the construction vehicles to the site without damaging crops or the terrain. Alternative anchors such as inground systems may be unusable in environmentally sensitive areas such as parks and other public lands where digging in the ground must be minimized.

Figure 5:
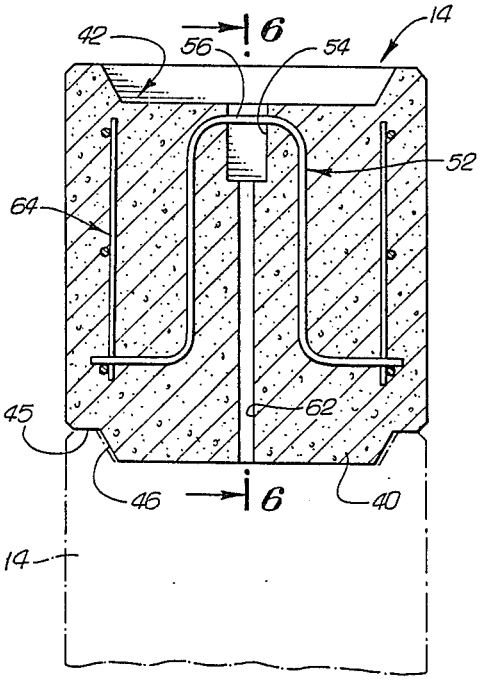
FIG. 5 is a cross sectional view of a modular block shown stacked on a similar block.

The anchors 10 of the illustrated embodiment overcome these obstacles by providing an above ground anchorage system which is easily transportable by truck or helicopter and utilizes a minimal amount of space during transport. As shown in FIG. 1, each modular block 14 may be transported one at a time to the site by a helicopter and deposited directly onto a base skid 12. The base skid 12 of the illustrated embodiment may accommodate up to six such modular blocks 14 in a first layer. Should additional weight be required, additional blocks 14 can be stacked on the first layer as shown in FIGS. 2 and 5. Since each modular block 14 has approximately the same weight, the number of blocks necessary for a particular application can be readily calculated by the engineer ahead of time and the appropriate number of blocks moved on to each skid 12. Blocks may be removed or further blocks added as necessary to provide the required resistance to the lateral and uplift forces being exerted by the guy wires on the anchors 10. Although the base skid 12 of the illustrated embodiment may accommodate up to six blocks 14 in the first layer, it is recognized of course that the base skid 12 may be readily modified to accommodate a greater or fewer number of blocks as is appropriate for each particular application.

As shown in FIGS. 1–4, the base skid 12 has a plurality of brackets or "vangs" 24 at spaced locations about the perimeter of the skid 12, to provide guy wire attachment points to the skid 12. Each vang 24 has a hole 26 (FIG. 3) through which the guy wire shackle (not shown) is attached. In the illustrated embodiment, the frame of the skid 12 is fabricated from steel wide flange members 28 welded together in the rectangular grid best seen in FIGS. 2 and 4. The vangs 24 are welded to the central web 30 of the outside perimeter flange members 28 as shown in FIG. 3.

To increase the resistance of the anchor 10 to lateral movement, the frame members 28 have a plurality of ground gripping cleats 32 welded to the frame underside as shown in FIGS. 3 and 4. The cleats 32 are triangular in cross-section and the ends of which are welded shut with end pieces 33 to keep out moisture to prevent rust. As shown in FIG. 4, the cleats 32 are orthogonally disposed on the skid frame to provide resistance to lateral movement in any direction.

FIG. 5 is a cross-sectional view of a typical modular block 14 shown stacked on a similar modular block. Each modular block 14 has a centrally located protrusion 40 on the bottom surface of the block. Each protrusion 40 is generally shaped as an inverted, truncated pyramid in which the pyramid has a square base. The protrusion 40 is adapted to mate with a similarly shaped recess 42 on the top surface of each block so that blocks stacked on top of one another securely interlock as shown in FIG. 5. The bottom layer of blocks 14 resting directly on the skid 12 interlock in a similar fashion to the skid 12. That is, the grid of flange members 28 forming the skid frame define a plurality of recesses or openings 44 (FIGS. 2 and 4) between the frame members 28. The frame openings 44 are generally square in shape and are sized somewhat larger than the maximum width of the block protrusions 40 so that the skid frame openings 44 receive the block protrusions 40. The outer perimeter 45 of the block bottom surface rests directly on the upper surface of the skid frame members 28, as shown in FIG. 2.

The interlocking of the upper and lower layers of blocks 14 and the interlocking of the lower layer of blocks 14 to the skid 12 increases the overall stability of the anchor 10. Thus, the skid 12 need not be placed on level ground but may be placed on terrain that is inclined to a certain extent. Moreover, the inclined walls 46 of the block protrusions 40 facilitate the proper registration of the blocks to the skid 12 and to each other as the blocks are lowered by the helicopter. The blocks 14 may be further secured to the skid 12 by means of straps or chains (not shown) which may be placed over the blocks and secured to attachment holes 50 spaced (FIG. 2) about the perimeter of the upper flange of the outside frame members 28.

Figure 6:
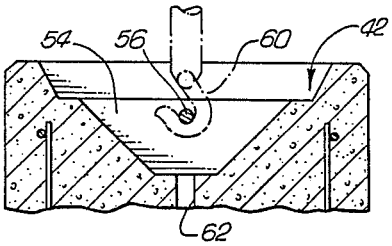
FIG. 6 is a partial cross-sectional view of the block of FIG. 5 with a lifting hook attached.

To facilitate the transportation of the modular blocks 14, each block 14 has an internal hooking member or bar 52 embedded within the block 14 as shown in FIG. 5. The hooking bar 52 is recessed below the surface of the upper recess 42 so that the hooking bar does not interfere with the interlocking of the stacked blocks. A second recess 54 in the center of the recess 42 provides access to the central portion 56 of the hooking bar 52. The recess 54 is of sufficient size to allow the insertion of a lifting hook 60 as shown in FIG. 6. To prevent rainwater from collecting within the recess 54, a drain channel 62 is provided through the center of the block 14 which allows the recess 54 to drain directly through the skid opening 44, or if stacked on a block 14, through the recesses 42 and 54 and the drain channel 62 of the block on which it is stacked.

Figure 7:
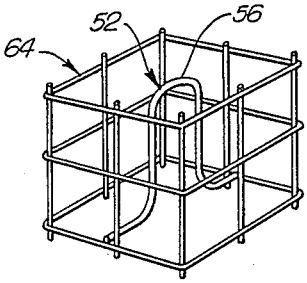
FIG. 7 is a pictorial view of the reinforcement cage and a lifting hook member of the modular block of FIG. 5.

The modular blocks 14 of the illustrated embodiment are approximately one cubic yard in size and are fabricated by placing concrete into a mold. The concrete is preferably placed around a reinforcement cage 64 such as that shown in FIG. 7. In the illustrated embodiment, the reinforcement cage 64 is fabricated with ASTM A615 grade 60 deformed new billet steel, and the concrete should have a minimum specified compressive strength of 3000 PSI at 28 days for safety purposes. In addition, the exposed portion 56 of the lifting bar 52 preferably is painted with a zinc rich paint to prevent rusting.

It should be apparent from the above description that a modular anchor in accordance with the present invention is readily transportable to most repair sites and may be quickly assembled by a crew of minimum size. Moreover, the modularity allows the weight of the anchor to be "customized" for each application. Still further, the interlocking feature of the anchor increases the safety in use and the ease of assembly of the modular blocks. Moreover, the modular anchor requires little or no site preparation, even for sites having an inclined terrain.

It will, of course, be understood that modifications of the present invention, in its various aspects, will be apparent to those skilled in the art, some being apparent only after study and others merely be matters of routine structural design. For example, it is recognized that the deadweight bodies 14 may have sizes and shapes other than the cubical blocks described. For example, rectangular or circular bodies might be utilized. In addition, the interlocking protrusions and recesses may have sizes and shapes other than those shown. Also, the deadweight bodies 14 and the skid 12 may be fabricated from materials other than those described, and the skid 12 may be modified to accommodate a different number of blocks.

Other embodiments are also possible, with their specific designs being dependent upon the particular application. Thus, for example, anchors in accordance with the present invention may be utilized to anchor other structures having an anchor line such as transmitter towers, barges and buoys. As such, the scope of the invention should not be limited by the particular embodiment herein described but should be defined only by the appended claims and equivalents thereof.

We claim:

1. An anchor for temporary structures having a guy line, comprising:

a base skid having means for attaching the guy line; and a body of predetermined mass adapted to rest on the skid to thereby weight down the skid, said body having a protrusion on the bottom surface of the body;

wherein the skid defines a recess adapted to receive the protrusion of the body so that substantial lateral movement of the body relative to the skid is prevented by engagement of the body protrusion with the skid recess.

2. The anchor of claim 1 further comprising at least one additional body as defined in claim 1 wherein the base skid has at least one additional recess as defined in claim 1 such that each recess is adapted to receive the protrusion of an associated body so that substantial lateral movement of the bodies relative to the skid is prevented by engagement of a body protrusion within an associated skid recess.

3. The anchor of claim 2 wherein each body defines a recess on the top surface of the body, said top surface body recess being adapted to receive the protrusion of the bottom surface of another body wherein the bodies may be stacked one on top of another with the protrusion of the upper body engaging the recess of the lower body to prevent substantial lateral movement of the upper and lower bodies relative to each other.

4. The anchor of claim 2 wherein each body comprises a generally cubical block of concrete.

5. The anchor of claim 2 wherein each body defines a recess and a hooking member embedded in the body and within the body recess, said hooking member and body recess being adapted to receive a hook to allow the body to be lifted by means of the hook.

6. The anchor of claim 3 wherein each body has a channel fluidically coupling the body recess to the exterior of the body to allow drainage of rain water which might otherwise collect in the body recess.

7. The anchor of claim 1 wherein each body comprises a concrete block having an internal metal reinforcement cage.

8. An anchor for structures having an anchor line, comprising:

a base skid having means for attaching the anchor line; and a plurality of interlocking bodies, each body having a predetermined mass and being adapted to be disposed one the skid to thereby weight down the skid, each body defining a protrusion on one surface of the body, and a recess on another surface of the body for receiving the surface protrusion of another such body resting against the body to thereby interlock the two bodies; and wherein the skid defines a plurality of recesses, each recess being adapted to receive the surface protrusion of a block resting on the skid.

9. An anchor for structures having an anchor line, comprising:

a base skid having means for attaching the anchor line; and a plurality of interlocking bodies, each body having a predetermined mass and being adapted to be disposed on the skid to thereby weight down the skid, each body defining a protrusion on one surface of the body, and a first recess on another surface of the body for receiving the surface protrusion of another such body resting against the body to thereby interlock the two bodies, each body also defining a second recess and an attachment member embedded in the body and within the second recess, said attachment member being adapted to be attached to a line to allow the body to be lifted by means of the line.

10. The anchor of claim 9 wherein each body has a channel fluidically coupling the second body recess to the exterior of the body to allow drainage of rain water which might otherwise collect in the body second recess.

11. An anchor for temporary structures having an anchor line, comprising:

a base skid adapted to rest on the ground and having means for attaching an anchor line; and a plurality of bodies, each body having a predetermined mass adapted to rest on the skid to thereby weight down the skid;

wherein the skid has a plurality of recesses, each recess being adapted to receive an associated body so that substantial lateral movement of the body relative to the skid is prevented by engagement of the body with the skid recess, said skid further having a plurality of cleats on the underside of the skid to increase the skid resistance of the base skid.

12. An anchor for temporary structures, comprising:

a base skid having a plurality of elongated members fastened in a grid pattern by thereby define a plurality of rectangular recesses between the members; and a plurality of blocks for weighting down the skid, each block being adapted to be received by a skid recess.

13. An anchor for temporary structures, comprising:

a base skid having a plurality of elongated members fastened in a grid pattern to thereby define a plurality of rectangular recesses between the members, said skid having a plurality of cleats on the underside of the members to increase the skid resistance of the base skid; and a plurality of modular blocks for weighting down the skid, each block having a recess and a protrusion adapted to be received by either a skid recess or a recess of a block stacked adjacent the block;

each block further having a second recess and a hooking member embedded within the block and extending through the second recess, said hooking member being adapted to be hooked to facilitate transport of each modular block.

14. An anchor for structures having an anchor line comprising:

a plurality of bodies, each body having a predetermined mass;

a base skid having a means for attaching the anchor line and adapted to support said plurality of bodies in direct contact therewith;

said skid and each said body having cooperating interlocking means for engaging with the skid said bodies that are in direct contact with the skid so that substantial lateral movement of said bodies relative to the skid is prevented.

15. The anchor of claim 14 wherein said plurality of bodies are blocks and further comprising at least one additional block of predetermined mass adapted to be supported on one or more of said plurality of blocks, said at least one additional block having on its lower surface and said one or more of said plurality of blocks having on its upper surface cooperating interlocking means for engaging said at least one additional block with said one or more of said plurality of blocks, so that substantial lateral movement of said at least one additional block relative to the skid is prevented.

16. The anchor of claim 15 wherein said plurality of blocks are disposed contiguously in rows and columns on said skid forming a first layer thereon, said at least one additional block forming a second layer on said first layer.

17. The anchor of claim 15 wherein each block comprises a generally cubical block of concrete.

18. The anchor of claim 17 wherein each concrete block has an internal metal reinforcement cage.

* * * * *